US006322940B1

(12) United States Patent
Nishigaki et al.

(10) Patent No.: US 6,322,940 B1
(45) Date of Patent: Nov. 27, 2001

(54) ELECTROPHOTOGRAPHIC PHOTORECEPTOR AND ELECTROPHOTOGRAPHIC IMAGE FORMING PROCESS

(75) Inventors: Satoshi Nishigaki, Nara; Hiroshi Sugimura, Habikino, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/479,052

(22) Filed: Jan. 7, 2000

(30) Foreign Application Priority Data

Jan. 8, 1999 (JP) ..... 11-002891

(51) Int. Cl.[7] ..... G03G 5/047

(52) U.S. Cl. ..... 430/58.65; 430/59.5; 430/59.6; 430/58.05; 430/970

(58) Field of Search ..... 430/970, 59.5, 430/58.65, 58.05, 59.6

(56) References Cited

U.S. PATENT DOCUMENTS

| | | | | |
|---|---|---|---|---|
| 3,357,989 | | 12/1967 | Byrne et al. . | |
| 4,150,987 | | 4/1979 | Anderson et al. . | |
| 4,214,907 | | 7/1980 | Nakazawa et al. . | |
| 4,387,149 | | 6/1983 | Emoto et al. . | |
| 4,471,039 | | 9/1984 | Borsenberger et al. . | |
| 4,557,868 | | 12/1985 | Page et al. . | |
| 4,725,519 | | 2/1988 | Suzuki et al. . | |
| 4,732,832 | | 3/1988 | Nogami et al. . | |
| 4,871,635 | | 10/1989 | Seki et al. . | |
| 4,898,799 | | 2/1990 | Fujimaki et al. . | |
| 5,132,197 | | 7/1992 | Iuchi et al. . | |
| 5,194,354 | | 3/1993 | Takai et al. . | |
| 5,380,613 | * | 1/1995 | Ueda et al. | 430/58.35 |
| 5,391,448 | | 2/1995 | Katayama et al. . | |
| 5,401,600 | | 3/1995 | Aizawa et al. . | |
| 5,401,615 | * | 3/1995 | Pai et al. | 430/970 |
| 5,501,930 | | 3/1996 | Kondo et al. . | |

(List continued on next page.)

FOREIGN PATENT DOCUMENTS

| | | |
|---|---|---|
| 37 16 975 A1 | 11/1987 | (DE) . |
| 196 38 447 A1 | 4/1997 | (DE) . |
| 197 44 029 A1 | 4/1998 | (DE) . |
| 0 658 814 A2 | 6/1995 | (EP) . |
| 0 715 216 A1 | 6/1996 | (EP) . |

(List continued on next page.)

OTHER PUBLICATIONS

Nitta et al., "Ultra–Precise Method of Joining a Polygon Mirror Using a Shrink Fitter (Simplification of Joining Method)", Japan Hardcopy '96, The Annual Conference of Japan Hardcopy for the Society of Electrophotography of Japan, Jul. 10–12, 1996, pp. 117–120.

Shimizu et al., "1200 dpi LED Print Head", Japan Hardcopy '96, The Annual Conference of Japan Hardcopy for the Society of Electrophotography of Japan, Jul. 10–12, 1996, pp. 125–128.

(List continued on next page.)

*Primary Examiner*—Christopher Rodee
(74) *Attorney, Agent, or Firm*—Nixon & Vanderhye

(57) ABSTRACT

An object of the invention is to implement a photoreceptor having high sensitivity and faithfully realizing high-density recording. An electrophotographic photoreceptor used for an image forming apparatus for forming a latent image at a resolution of 1200 dpi or more by exposing an object to light and visualizing the latent image with a reversal development system using a toner having an average particle size of 6 $\mu$m or less, which comprises an electrically conductive support, and a photosensitive layer composed of a charge generating layer formed on the electrically conductive support, and a charge transport layer formed on the charge generating layer, having a thickness of 20 $\mu$m or less.

6 Claims, 6 Drawing Sheets

U.S. PATENT DOCUMENTS

| | | | | |
|---|---|---|---|---|
| 5,538,826 | * | 7/1996 | Ainoya et al. | 430/58 |
| 5,556,728 | | 9/1996 | Nogami et al. . | |
| 5,585,212 | | 12/1996 | Ueda . | |
| 5,677,096 | | 10/1997 | Suzuki . | |
| 5,736,282 | | 4/1998 | Tamura et al. . | |
| 5,744,271 | | 4/1998 | Aizawa et al. . | |
| 5,891,594 | * | 4/1999 | Yuh et al. | 430/78 |
| 5,905,009 | | 5/1999 | Nakamura et al. . | |
| 5,958,638 | | 9/1999 | Katayama et al. . | |
| 5,965,311 | | 10/1999 | Suzuki . | |
| 6,057,075 | * | 5/2000 | Yuh et al. | 430/135 |

FOREIGN PATENT DOCUMENTS

| | | |
|---|---|---|
| 1268422 | 3/1972 | (GB) . |
| 49-11136 A | 1/1974 | (JP) . |
| 54-59143 A | 5/1979 | (JP) . |
| 58-32373 B2 | 7/1983 | (JP) . |
| 58-198043 A | 11/1983 | (JP) . |
| 59-49544 A | 3/1984 | (JP) . |
| 59-155851 A | 9/1984 | (JP) . |
| 60-86551 A | 5/1985 | (JP) . |
| 61-28557 A | 2/1986 | (JP) . |
| 61-217050 A | 9/1986 | (JP) . |
| 61-239248 A | 10/1986 | (JP) . |
| 62-67094 A | 3/1987 | (JP) . |
| 62-133462 A | 6/1987 | (JP) . |
| 63-20365 A | 1/1988 | (JP) . |
| 63-366 A | 1/1988 | (JP) . |
| 63-198067 A | 8/1988 | (JP) . |
| 1-17066 A | 1/1989 | (JP) . |
| 2-8256 A | 1/1990 | (JP) . |
| 3-54264 A | 3/1991 | (JP) . |
| 3-54265 A | 3/1991 | (JP) . |
| 3-128973 A | 5/1991 | (JP) . |
| 5-31137 B2 | 5/1993 | (JP) . |
| 5-55860 B2 | 8/1993 | (JP) . |
| 6-1386 B2 | 1/1994 | (JP) . |
| 6-29975 B2 | 4/1994 | (JP) . |
| 6-202366 A | 7/1994 | (JP) . |
| 7-5851 B2 | 1/1995 | (JP) . |
| 7-15067 B2 | 2/1995 | (JP) . |
| 7-30267 B2 | 4/1995 | (JP) . |
| 7-244388 A | 9/1995 | (JP) . |
| 7-261415 A | 10/1995 | (JP) . |
| 7-271073 A | 10/1995 | (JP) . |
| 7-91486 B2 | 10/1995 | (JP) . |
| 2502404 B2 | 3/1996 | (JP) . |
| 8-209023 A | 8/1996 | (JP) . |
| 9-127711 A | 5/1997 | (JP) . |
| 2696400 B2 | 9/1997 | (JP) . |
| 2700859 B2 | 10/1997 | (JP) . |
| 10-142819 A | 5/1998 | (JP) . |
| 11-52601 A | 2/1999 | (JP) . |

OTHER PUBLICATIONS

Kawamura, "Increase of Image Quality of Electrophotography—Digital Recording Technique", Electrophotography (The Society Journal, Society of Electrophotography of Japan), vol. 26, No. 1, 1987, pp. 75–83.

Miyazaki, "Photoreceptors for Digital Electrophotography", Electrophotography (The Society Journal, Society of Electrophotography of Japan), vol. 32, No. 3, 1993, pp. 282–289.

USSN 09/379,639, filed Aug. 24, 1999, entitled Electro–Photographic Photoreceptor and Image–Forming Apparatus Using Same.

USSN 09/428,061, filed Oct. 27, 1999, entitled Crystalline Oxotitanylphthalocyanine and Electrophotographic Photoreceptor Using the Same.

Arimoto et al., "High Image Quality of Laser Printer Using Variable Spot Laser", O Plus E, No. 198, May 5, 1996, pp. 102–106 w/ partial translation.

Section Ch, Week 198941, Derwent Publications Ltd., London, GB; AN 1989–295914 XP002124411 & JP 01 217359 A (Konica) Aug. 30, 1989.

Section Ch, Week 198913, Derwent Publications Ltd., London, GB; AN 1989–097610 XP002124412 & JP 01 046764 A (Ricoh) Feb. 21, 1989.

Sawada, "Phthalocyanine Pigments as Electrophotographic Photoreceptive Material", Dyes and Chemicals, vol. 24, No. 6, 1979, pp. 122–128.

Miyazaki, "Photoreceptors for Digital Electrophotography", The Society Journal, Society of Electrophotography of Japan, vol. 32, No. 3, 1993, pp. 282–289.

Oka et al., "Study of the Relationship Between Crystal Structure and Phtosensitivity of Phthalocyanine Pigments" Journal of Imaging Science and Technology, vol. 37, No. 6, Nov./Dec. 1993, pp. 607–609.

Moser et al., Phthalocyanine Compounds, "Chapter 3 Preparation", ©Reinhold Publishing Corporation, 1963, pp. 104–141.

Database WPI, Section Ch, Week 199350, Derwent Publications Ltd., London, GB, AN 1993–400932 XP002135887 & JP 05 303213 A (Mitsubishi Paper Mills Ltd.), Nov. 16, 1993.

Database WPI Section CH, Week 198937, Derwent Publications Ltd., London, GB; AN 1989–267928 XP002135888 & JP 01 195455 A (Minolta Camera KK), Aug. 7, 1989.

Database WPI Section CH, Week 199011, Derwent Publications Ltd., London, GB; AN 1990–078212 XP002135889 & JP 02 029661 A (Asahi Chem Ind Co. Ltd.), Jan. 31, 1990.

* cited by examiner

ELECTROPHOTOGRAPHIC PHOTORECEPTOR AND ELECTROPHOTOGRAPHIC IMAGE FORMING PROCESS

BACKGROUND OF THE INVENTION

1. Field of the Invention

The present invention relates to an electrophotographic photoreceptor for use in printers, digital copying machines, facsimiles, etc., and to a method for forming an electrophotographic image.

2. Description of the Related Art

At present, an electrophotographic system typified by the Carlson system has been widely used for its high-speed recording ability, high image quality, and non-impact property. In the electrophotographic system at present, (a) uniformly charging a photoreceptor, (b) writing image information by light (forming a latent image), (c) forming a toner image with a developer, (d) transferring the toner image onto a plain paper, and (e) fixing the toner image are fundamental processes. Recently, in particular, with the employment of image information as a digital information, a system in which laser light or LED array light is employed as a light source in place of white light in the prior art systems has been widely used and thereby an output image of higher image quality has been demanded.

In response to the demand, in an optical recording head and an optical recording system, a development has been proceeded aiming at a high-speed property and the increase of resolution, and for example, variable spot laser recording system (O plus E, 1996, May), multilaser beam recording system, an LED print head for 1200 dpi resolution, and further super-precise and super-high-speed polygon mirror (Japan Hard Copy '96, theses collection), etc., have been developed.

Because in the system in which such a semiconductor laser or an LED array is used as a recording light source, an image is represented by the assembly or array of fine dots called pixels, a technique of forming fine spots by increasing the resolving power of the optical system becomes inevitable and consequently in the optical system side, a recording density of 1200 dpi or more has become possible.

Also, what is important for obtaining high image quality is not only the optical system, but also, together with techniques of reducing the particle sizes of toner particles and minimizing the occurrence of scattering of toner at the development or transferring stages, an image-processing technique which processes image data to match the image-reproducing characteristics of the electrophotography.

As the technique of reducing the particle sizes of toner particles, for example, Japanese Examined Patent Publication JP-B2 2696400 discloses an image forming method in which digital exposure is carried out at a recording density of 600 dpi or more and a toner having a particle size of 8 $\mu$m or less is used. However, it has been known that in the case of forming a high quality digital image having a recording density of 1200 dpi or more, it is difficult to faithfully reproduce, only by limiting the weight average particle size of a toner, an electrostatic latent image formed on a photoreceptor, and it is necessary to design the photoreceptor so as to incur no deterioration of the recording density.

In general, visually observed image quality is determined by the synergistic effect of the resolution and the gradient, and prints of a work of art etc. have a resolution of at most 200 dpi but an image of high quality is obtained because a 256-step tone can be expressed. It is said that human eyes have the faculty to detect a resolution of 300 dpi and a density of a 64-step tone, and so it is clear that in terms of gradation, in area gradation, high resolution is advantageous and in density gradation, the number of steps in tone may be low, and an image forming method considering this balance becomes important. Taking into consideration the stability of images with the passage of time, stability of images in a variety of environments, etc., and when the instability of halftone density in the electrophotography is considered, for realizing a high quality stable image, in dealing with gradation it is most advantageous to increase the resolution of the area gradation.

Also, the report "Increase of Image Quality of Electrophotography—Digital Recording Technique" in Electrophotography (The Society Journal, Society of Electrophotography of Japan), Vol. 26, No. 1, (1987), a technical explanation of method of increasing the image quality of electrophotography. In the report, it is stated that when the pulse width modulation method is used as a laser multivalue output method, the peak value of the light energy distribution is lowered, and because the distribution is linked with the intensity modulation characteristics, the electrostatic latent image potential distribution shows an intermediate value between a dark charging potential and a bright surface potential. However, it is clear that as recording comes to have higher resolution and as recording of more values is carried out, a photoreceptor having high sensitivity and high resolution becomes necessary.

However, investigations into the relation between a photoreceptor itself and the resolution, or the relation between a photoreceptor used in a recording system and the resolution are rare and the resolution of a photoreceptor itself has not hitherto been treated as a problem. This is because in a recording density of from 400 dpi to 600 dpi, a photoreceptor of the film thickness which has hitherto has been in practical use has sufficient resolution, and the deterioration of the resolution based on carrier diffusion due to the film thickness does not become a problem. Rather, for increasing the sensitivity as well as for prolonging the life of image, a photoreceptor having a thicker film thickness has been investigated thereof. For example, in Japanese Unexamined Patent Publication JP-A 7-244388 (1995) and 7-261415 (1995), techniques of increase the film thickness of photoreceptor to 27 $\mu$m or thicker are reported.

On the other hand, for the performance required of a photoreceptor employed for digital recording, there are the following new requirements. When digital image formation is carried out by directly utilizing information from a computer, information such as a letter is converted into a light signal and is recorded on a photoreceptor. On the other hand, when digital image processing is carried out by inputting information from a manuscript, after reading the manuscript information as light information, the light information is converted into a digital electric signal, which is converted again into a light signal and is recorded on a photoreceptor. In each case, the information is recorded on the photoreceptor as the light information, and as chief recording means, a laser light or an LED light is used. The recording means which is used well at present is a near infrared light source having a wavelength of 780 nm or an infrared light source having a wavelength of 650 nm. The photoreceptor for digital recording is required to have high sensitivity to these light sources, and crystal-type phthalocyanine-base compounds have been widely investigated and have been practically used. For example, in Japanese Patent No. JP-C 2073696 (JP-B2 5-55860), a photoreceptor using a titanyl phthalocyanine is described, in Japanese Unexamined Patent Publication JP-A 59-155851 (1984), a photoreceptor using β-type indium phthalocyanine is described, and in Japanese Unexamined Patent Publication JP-A 61-28557 (1986), a photoreceptor using vanadium phthalocyanine is described.

Also, it is reported that in the case of a crystal-type titanyl phthalocyanine, there exist various crystal systems and according to a difference in the crystal systems, there are large differences in a charging property, dark decay, sensitivity, etc. Particularly, in these phthalocyanines, the investigation of oxotitanyl phthalocyanine, which shows high sensitivity, has been vigorously carried out. Oxotitanyl phthalocyanine alone has been classified into many crystal types from a difference in diffraction angles of X-ray diffraction spectra as described in Electrophotography (The Society Journal, Society of Electrophotography of Japan), Vol. 32, No. 3, p. 289. Specifically, characteristic crystals are shown as follows. An α-type crystal is described in Japanese patent No. JP-C 2007449 (JP-B2 6-29975), an A-type crystal in Japanese Patent No. JP-C 1917796 (JP-B2 5-31137), C-type crystals in Japanese Patent No. JP-C 1876697 (JP-B2 6-1386) and 1997269 (JP-B2 7-30267), Y-type crystals in Japanese Patent No. JP-C 1950255 (JP-B2 6-39575) and 2128593 (JP-B2 7-91486), an M-α-type crystal in Japanese Examined Patent Publication JP-B2 7-15067 (1995), I-type crystals in Japanese Examined Patent Publication JP-B2 2502404, and an M-type crystal in Japanese Patent No. JP-C 1978469 (JP-B2 7-5851). Furthermore, in Japanese Examined Patent Publication B-2 2700859 and Japanese Unexamined Patent Publication JP-A 8-209023 (1996), crystals fundamentally classified in the Y-type crystal are described.

In crystal-type oxotitanyl phthalocyanine, there are various crystal systems, and accordingly it is necessary to specify the configuration of the crystal lattice of the oxotitanyl phthalocyanine is required. It is reported that in the crystal-type oxotitanyl phthalocyanine, according to the differences in such crystal systems, there are large differences in the charging property, the dark decay, the sensitivity, etc.

As described above, in order to increase image quality, investigation into increasing the resolution of the photoreceptor itself is required and also the investigation of a highly sensitive photoreceptor faithfully reproducing high-density recording of from 1500 dpi to 2400 dpi is required. In recording density of 600 dpi or lower at present, the film thickness of the photoreceptor practically used is from 20 to 35 μm. The film thickness has been established in consideration of the sensitivity, printing durability (the life of the photoreceptor), etc., required at the photoreceptor. A latent image formed on the photoreceptor does not give a problem with regard to the reproducibility of the recording density. However, in the case of the latent image having a high density of 1500 dpi or higher, because in the photoreceptor having a film thickness of 20 μm or thicker, carrier diffusion occurs due to the carrier traveling distance of the photoreceptor to cause the deterioration of the resolution, a problem that the faithful reproduction of the image becomes difficult has been resolved by the present inventors' investigations.

Also, for preventing the deterioration of the resolution of the latent image formed on a photoreceptor which is required to have high resolution, it becomes necessary to increase the surface charge density and to thin the film thickness of the photoreceptor to the extent that the deterioration through the diffusion of the carrier does not cause a problem. However, when the film thickness of a photoreceptor is thin, electric field intensity applied to a photosensitive layer is increased and thus there occur new problems such as the need for improving the pressure resistance of the photosensitive layer, and the loss of effective sensitivity accompanied by the increase of electric capacity. The problem of pressure resistance causes the formation of minute defects in the image through reversal development, and the problem of loss of effective sensitivity causes lowering of potential contrast and also causes a vicious circle of further increasing both a surface potential and the power of the recording light source, needed to ensure sufficient image density.

SUMMARY OF THE INVENTION

An object of the present invention is to provide a high-sensitive electrophotographic photoreceptor capable of faithfully reproducing high-density images and to provide a method for forming an electrophotographic image using the same.

The invention provides an electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising an electrically conductive support; and a photosensitive layer composed of a charge generating layer formed on the electrically conductive support, containing a charge generating material, and a charge transport layer formed on the charge generating layer, having a thickness of 20 μm or less and containing a charge transporting material.

According to the invention, a high-density image having a high resolution of 1200 dpi or more and high image quality which is achieved with the toner having the average particle size of 6 μm or less is obtained. Also, by reducing the thickness of the charge transport layer of a lamination-type photoreceptor to 20 μm or less, the diffusion of a carrier which is caused at the exposure to light is restrained and the deterioration of the resolution of the latent image can be prevented, whereby a high-density image can be faithfully reproduced.

The invention provides an electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing a charge transporting material.

According to the invention, a high-density image can be faithfully reproduced. Also, using the oxotitanyl phthalocyanine as the charge generating material, high sensitivity and high printing durability can be obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4° 9.6° and 27.2° and shows diffraction lines at Bragg angles (2θ±0.2°) of 7.3°, 11.6° and 24.1°.

According to the invention, by using the oxotitanyl phthalocyanine which shows the X-ray diffraction spectrum as described above, an electrophotographic photoreceptor having higher sensitivity and higher printing durability can be obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.20°) of 9.3°, 9.5°, 9.7° and 27.2°.

According to the invention, by using the oxotitanyl phthalocyanine which shows the X-ray diffraction spectrum as described above, an electrophotographic photoreceptor having higher sensitivity and higher printing durability can be obtained.

The invention provides an electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing an enamine structural material shown by the following formula (I) as a charge transporting material;

(I)

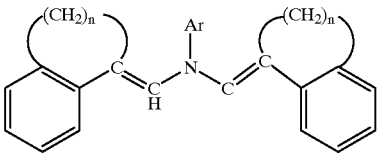

wherein Ar represents an aryl group which may have a substituent, a heterocyclic group which may have a substituent, an aralkyl group which may have a substituent, or a heterocyclic alkyl group which may have a substituent, and n represents 2, 3 or 4.

According to the invention, a high-density image can be faithfully reproduced and high sensitivity and high printing durability can be obtained. Also, by using the enamine structural material described above as the charge transporting material, the injection efficiency of a carrier is increased and higher sensitivity is obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4°, 9.6°, and 27.2° and shows diffraction lines at Bragg angles (2θ±0.2°) of 7.3°, 11.6°, and 24.1°.

According to the invention, by using the oxotitanyl phthalocyanine which shows the X-ray diffraction spectrum as described above, an electrophotographic photoreceptor having higher sensitivity and higher printing durability can be obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.3°, 9.5°, 9.7°, and 27.2°.

According to the invention, by using the oxotitanyl phthalocyanine which shows the X-ray diffraction spectrum as described above, an electrophotographic photoreceptor having higher sensitivity and higher printing durability can be obtained.

The invention provides an electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing a binder resin and a charge transporting material, wherein the binder resin is a polycarbonate having a viscosity-average molecular weight of from 35000 to 85000, shown by the following formula (II);

(II)

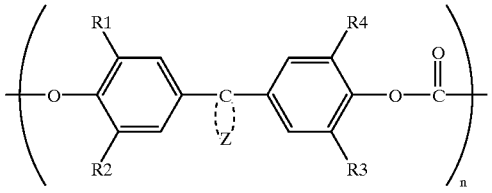

wherein $R_1$ to $R_4$ each represents a hydrogen atom, a halogen atom, or an alkyl group having from 1 to 4 carbon atoms; Z represents an atomic group necessary for forming an unsubstituted carbon ring or a substituted or unsubstituted heterocycle.

According to the invention, a high-density image can be faithfully reproduced, high sensitivity and high printing durability can be obtained. Also, by including the polycarbonate described above as a binder resin for the charge transport layer, an electrophotographic photoreceptor having higher sensitivity is obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4°, 9.6°, and 27.2° and shows diffraction lines at Bragg angles (2θ±0.2°) of 7.3°, 11.60°, and 24.1°.

According to the invention, by using the oxotitanyl phthalocyanine which shows the X-ray diffraction spectrum as described above, an electrophotographic photoreceptor higher sensitivity and higher printing durability can be obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.3°, 9.5°, 9.7°, and 27.2°.

According to the invention, by using the oxotitanyl phthalocyanine which shows the X-ray diffraction spectrum as described above, an electrophotographic photoreceptor having higher sensitivity and higher printing durability can be obtained.

The invention provides an electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing an antioxidant and a charge transporting material, wherein the antioxidant is at least any one of α-tocopherol, t-butylhydroquinone, and t-butylhydroxytoluene, and a weight ratio of the antioxidant to the charge transport layer is selected in a range of from 5/1000 to 50/1000.

According to the invention, a high-density image can be faithfully reproduced, and high sensitivity and high printing durability can be obtained. Also, by containing a definite amount of the above-described material as an antioxidant in the charge transport layer, potential characteristics can be stably obtained.

In the invention, it is preferable that the charge transport layer contains an enamine structural material shown by the following formula (I) as the charge transporting material;

(I)

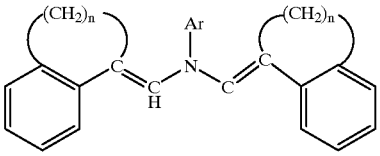

wherein Ar represents an aryl group which may have a substituent, a heterocyclic group which may have a substituent, an aralkyl group which may have a substituent, or a heterocyclic alkyl group which may have a substituent, and n represents 2, 3, or 4.

According to the invention, a high-density image can be faithfully reproduced, high sensitivity and high printing durability can be obtained, and also the stabilized potential characteristics are obtained. Also, by using the enamine structural material described above as the charge transporting material, the injection efficiency of a carrier is increased and higher sensitivity is obtained.

In the invention, it is preferable that the charge transport layer further contains a binder resin, which binder resin is a polycarbonate shown by the following formula (II) having a viscosity-average weight of from 35000 to 85000;

(II)

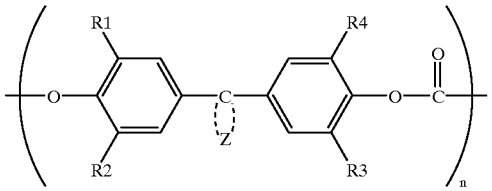

wherein $R_1$ to $R_4$ each represents a hydrogen atom, a halogen atom, or an alkyl group having from 1 to 4 carbon atoms; Z represents an atomic group necessary for forming an unsubstituted carbon ring or a substituted or unsubstituted heterocycle.

According to the invention, a high-density image can be faithfully reproduced, high sensitivity and high printing durability can be obtained, and also the stabilized potential characteristics are obtained. Also, by containing the polycarbonate described above as the binder resin for the charge transport layer, higher sensitivity is obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4°, 9.6°, and 27.2° and shows diffraction lines at Bragg angles (2θ±0.2°) of 7.3°, 11.6°, and 24.1°.

According to the invention, by using the oxotitanyl phthalocyanine which shows the X-ray diffraction spectrum as described above, higher sensitivity and higher printing durability can be obtained.

In the invention, it is preferable that the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.3°, 9.5°, 9.7°, and 27.2°.

According to the invention, by using the oxotitanyl phthalocyanine which shows the X-ray diffraction spectrum as described above, higher sensitivity and higher printing durability can be obtained.

In the invention, it is preferable that the electrophotographic photoreceptor further comprises an interlayer between the photosensitive layer and the electrically conductive support.

According to the invention, a high-density image can be more faithfully reproduced.

Also, the invention provides a method for forming an electrophotographic image using a toner and an electrophotographic photoreceptor with a reversal development system, the method comprising: using a toner having an average particle size of 6 μm or less, and a standard deviation of weight average particle size of 30% or lower of an average value of the weight average particle size, the toner containing less than 10% toner having a particle size outside the standard deviation, wherein the electrophotographic photoreceptor is any one of the electrophotographic photoreceptors described above.

According to the invention, a method for forming an electrophotographic image capable of faithfully reproducing a high-density image can be provided.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
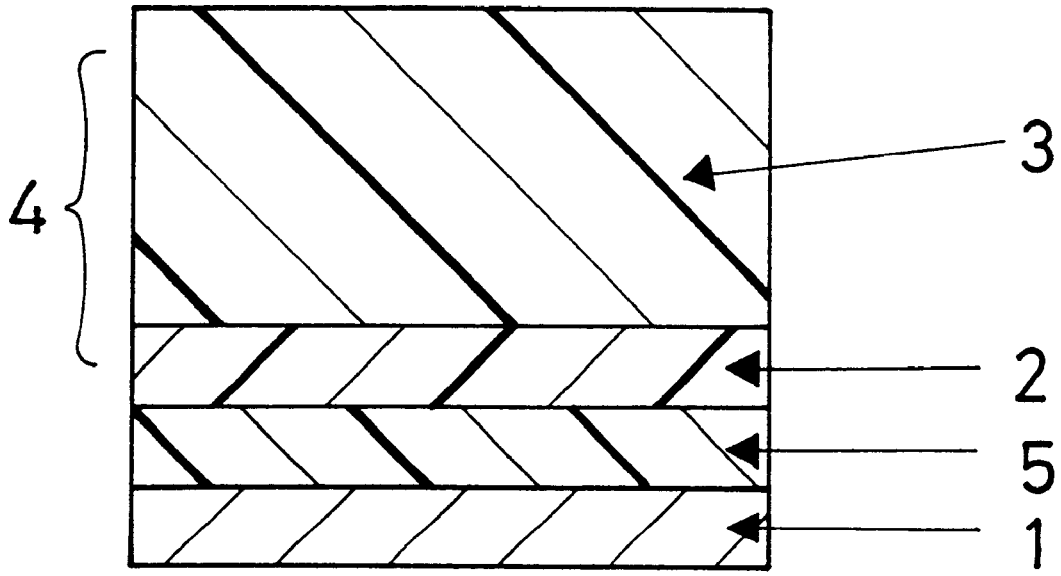
FIG. 1 is a schematic cross-sectional view showing the layer structure of an electrophotographic photoreceptor of the invention.

Now referring to the drawings, preferred embodiments of the invention are described below.

Then, the present invention is described in detail.

In the present invention, with a charge transport layer thinner than those in the prior art electrophotographic photoreceptors, high resolution is attained. By reducing the film thickness of the charge transport layer, the deterioration of the resolution of an electrostatic latent image by the diffusion of a carrier is restrained and the problem of lowering the resolution related to the film thickness of a photoreceptor itself is solved. Also, it has been found that the new problems of the occurrence of minute defects in images and the lowering of sensitivity caused by thinning the film thickness of the photoreceptor can be solved by the existence of an interlayer which becomes an effective carrier injection preventing layer formed between an electrically conductive support and a charge generating layer, the employment of a charge generating layer made of a high-sensitive crystal-type oxotitanyl phthalocyanine which has very little release of carrier which becomes a free carrier even in a high electric field in the dark, and the employment of a charge transport layer made of a hole transporting material of a good carrier injection efficiency having an enamine structure, whereby a photoreceptor having the high-sensitivity characteristics is obtained.

As the construction of an electrophotographic photoreceptor of the invention, as shown in FIG. 1, a photosensitive layer 4 is laminated on an electrically conductive support 1, the photosensitive layer 4 is composed of two layers: a charge generating layer 2 and a charge transport layer 3, and between the electrically conductive support 1 and the charge generating layer 2 is formed an interlayer 5.

As the electrically conductive support 1 in the invention can be used a substrate made of material which is electric conductive in itself, such as aluminum, aluminum alloys, copper, zinc, stainless steel, nickel, titanium, etc., and further, a substrate made of plastic or paper vapor-deposited with aluminum, gold, silver, copper, zinc, nickel, titanium, indium oxide, tin oxide, etc., plastic or paper containing electrically conductive particles, or plastic containing an electrically conductive polymer etc., can be used in the form of a drum, a sheet, a seamless belt, etc.

Most preferably, an interlayer made of a resin layer which is a rutile-type titanium oxide crystal dispersed polyamide resin is interposed between the electrically conductive support 1 and the charge generating layer 2. As the rutile-type titanium oxide crystal may be used one subjected to a surface treatment or not so treated, in any of a spherical form, an acicular form and an irregular form. For the polyamide resin, an alcohol-soluble nylon is preferred, and a so-called copolymer nylon formed by copolymerizing 6-nylon, 66-nylon, 610-nylon, 11-nylon, 12-nylon, etc.; and chemically modified nylons such as N-alkoxymethylated modified nylon and N-alkoxyethylated modified nylon can be used.

The interlayer 5 is formed by coating on the electrically conductive support 1 a coating liquid obtained by grinding and dispersing the polyamide resin and rutile-type titanium oxide crystal particles in an organic solvent by a ball mill, a sand grinder, a paint shaker, an ultrasonic dispersing machine, etc. In the case of a sheet, methods of using a Baker applicator, a bar coater, and by casting and spin coating, etc., are known, and in the case of a drum, a spray method, a vertical-type ring method, and a dip coating method are known, but because of simplicity of an apparatus, a dip coating method is generally used. The film thickness of the interlayer 5 is preferably from 0.01 $\mu$m to 20 $\mu$m, and more preferably from 0.05 $\mu$m to 10 $\mu$m.

Preferably the charge generating material is crystalline oxotitanyl phthalocyanine compounds, and more preferably compounds which show, in an X-ray diffraction spectrum of CuK$\alpha$ characteristic X-ray (wavelength: 1.5418 Å), main strong diffraction lines at Bragg angles (2$\theta$±0.2°) of at least 9.4°, 9.60, and 27.2° and shows diffraction lines at Bragg angles (2$\theta$±0.2°) of 7.3°, 11.6°, and 24.1° and compounds which show strong diffraction lines of the same strong intensity at Bragg angles (2$\theta$±0.2°) of at least 9.3°, 9.5°, 9.7°, and 27.2°.

It is a usual formation method of the charge generating layer 2 to apply a coating liquid which is prepared by dispersing the fine particles of the phthalocyanine compound in an organic solvent, by an apparatus the same as the case of forming the interlayer 5. In this case, to increase binding property, various binder resins such as poly(vinyl butyral), a polyester resin, polyvinyl acetate, polyacryate, polycarbonate, polyarylate, poly(vinyl acetoacetal), poly (vinyl propional), a phenoxy resin, an epoxy resin, a urethane resin, a melamine resin, a silicone resin, an acrylic resin, a cellulose ester, a cellulose ether, a vinyl chloride-vinyl acetate copolymer resin may be added to the coating liquid.

Also, as the organic solvent, ketones such acetone, methyl ethyl ketone, methyl isobutyl ketone, cyclohexanone, etc., are suitable in order to obtain the stability of the coating liquid and the stability of the crystal type but the solvent can be also used as a mixture with esters such as ethyl acetate, butyl acetate, etc.; ethers such as tetrahydrofuran, dioxane, etc.; aromatic hydrocarbons such as benzene, toluene, xylene, etc., and aprotic polar solvents such as N,N-dimethyl formamide, dimethyl sulfoxide, etc. The film thickness of the charge generating layer 2 formed is from 0.05 to 5 $\mu$m, and preferably from 0.01 to 1 $\mu$m. Also, if necessary, the charge generating layer 2 may contain various additives such as a leveling agent, an antioxidant, a sensitizer, etc., for improving a coating property.

The charge transport layer 3 mainly comprises a charge transporting material and a binder resin. As the charge transporting material, the enamine-base compound shown by formula (I) described below is particularly suitable in view of its injection efficiency but as for other materials, there are electron-attracting substances such as 2,4,7-trinitrofluorenone, tetracyanoquinodimethane, etc.; heterocyclic compounds such as carbazole, indole, imidazole, oxazole, pyrazole, oxadiazole, pyrazoline, thiazole, etc.; aniline derivatives; hydrazone compounds, aromatic amine derivatives; styryl compounds, etc. And of the above materials which are partially crosslinked and cured may also be used. These charge transporting materials may be used singly or in mixtures.

(I)

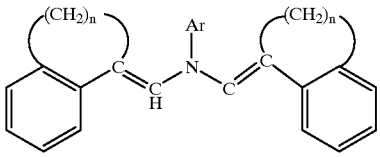

wherein Ar represents an aryl group which may have a substituent, a heterocyclic group which may have a substituent, an aralkyl group which may have a substituent, or a heterocyclic alkyl group which may have a substituent, and n represents 2, 3, or 4.

Also, a preferable binder resin to use for the charge transport layer 3 includes vinyl polymers such as poly (methyl methacrylate), polystyrene, poly(vinyl chloride), etc.; and the copolymers thereof; polyester, polyester carbonate, polyarylate, polysulfone, polyimide, a phenoxy resin, an epoxy resin, a silicone resin, etc. They can be used singly or as a mixture of two or more kinds thereof, or copolymers of the monomers constituting the resins described above and partially crosslinked thermosetting resins can be also used.

A particularly preferred binder resin is a polycarbonate resin shown by the following formula (II) and having a viscosity-average molecular weight of from 35000 to 85000;

(II)

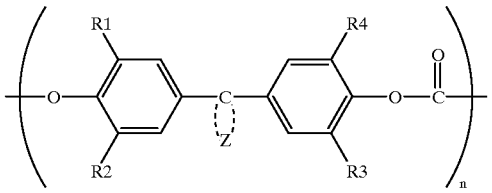

wherein $R_1$ to $R_4$ each represents a hydrogen atom, a halogen atom, or an alkyl group having from 1 to 4 carbon atoms; Z represents an atomic group necessary for forming an unsubstituted carbon ring or a substituted or unsubstituted heterocycle.

As the ratio of the binder resin and the charge transporting material, usually, the charge transporting material is used in the range of from 30 to 200 parts by weight, and preferably from 40 to 150 parts by weight to 100 parts by weight of the binder resin. And, the film thickness of the charge transport layer is preferably 20 μm or less. In addition, the charge transport layer 3 can suitably contain, particularly vitamin E, hydroquinone, or a hydroxytoluene compound because in this case, a remarkable stabilization of potential characteristics is obtained. Also, it is preferred that the antioxidant described above is incorporated in the charge transport layer 3 in a weight ratio of 5/1000 to about 50/1000. Also, the charge transport layer 3 may further contain additives such as plasticizers, antioxidants, ultraviolet absorbents, leveling agents, etc. well-known to improve a film-forming property, flexibility, the coating property, etc. The charge transport layer 3 is formed by coating on the charge generating layer 2 by the same apparatus as used in the case of forming the interlayer 5.

The photoreceptor obtained as described above, for example, has high sensitivity while retaining high resolution characteristics in the long wavelength region of near-infrared region, and can constitute an electrophotographic process in which a good image formation can be carried out without minute image defects.

An image forming method of the invention includes at least a charging step, a light-exposure step, a reversal development step, and a transfer step and each step may be carried out by using ordinary used methods. For a charging method, for example, a corotron charging method or a scorotron charging method utilizing corona discharging, or a contact charging method with an electrically conducting roller or brush may be used. In a charging method utilizing corona discharging, to keep a dark portion potential constant, the scorotron charging method is frequently used. As a method of exposure to light, a light source for exposure having a main energy peak in the region of from 600 to 850 nm, such as a semiconductor laser, etc., is used by adjusting to a specific beam diameter by an optical system. For a developing system, the development is carried out in a contact system or a non-contact system using a magnetic or non-magnetic one-component or two-component developer comprising a small-particle size toner having a particle size of 6 μm or less, and in each case, a reversal development of a bright portion potential is used. For a transfer method, a method by corona discharging or a method of using a transfer roller may be used. The transferred toner image is fixed for this, a fixing process of fixing the toner image onto paper, in the fixing process, heat fixing or press fixing generally used can be used. In addition to these steps, a cleaning step, a static eliminating step, etc., may be carried out. In order to obtain an image having a high resolving power and a high gradation, a small particle size toner having an average particle size of 6 μm or less, wherein the particle size distribution thereof is sharp, is particularly desirable. Practically, it is preferred to use a toner having a standard deviation which is 30% or lower of a weight average particle size and containing less than 10% toner having the particle sizes outside the standard deviation.

Then, the present invention is practically explained by the following examples but the invention is not limited to these examples within the scope of the invention.

EXAMPLE 1

To a mixture of 287 parts by weight of methanol and 533 parts by weight of 1, 2-dichloroethane were added 72.6 parts by weight of titanium oxide (STR-60N: made by Sakai Chemical Ind. Co., Ltd.) and 107.4 parts by weight of copolymer nylon (Amilan CM8000: made by Toray Industries Inc.) and they were dispersed by a paint shaker for 8 hours to prepare a coating liquid for forming an interlayer. The coating liquid was filled in a tank, a cylindric aluminum support having a diameter of 65 mm and a length of 332 mm was dipped in the tank, and the support was pulled up thus coated, and dried at 110° C. for 10 minutes to form an interlayer having a thickness of about 1 μm.

Figure 2:
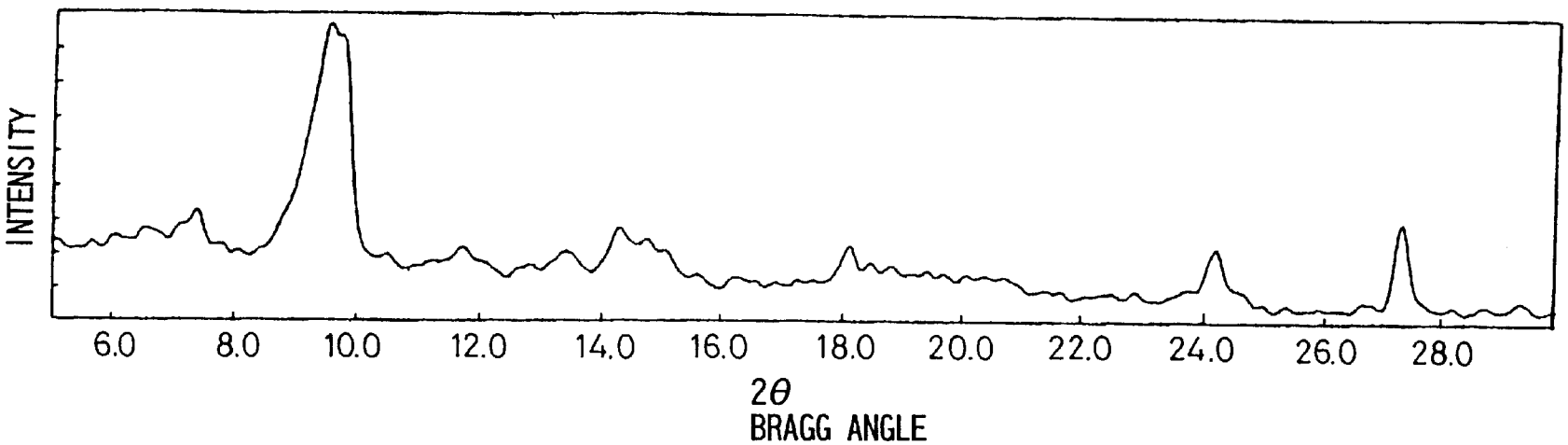
FIG. 2 is a view showing the X-ray diffraction pattern of a crystal-type titanyl phthalocyanine used in the invention.

Then, 2 parts by weight of a crystal type oxotitanyl phthalocyanine which shows, in an X-ray spectrum of CuKα characteristic X-ray (wavelength: 1.5418 Å), main strong diffraction lines at Bragg angles (2θ±0.2°) of 9.4°, 9.6°, and 27.2° and diffraction lines at Bragg angles (2θ±0.2°) of 7.3°, 11.6°, and 24.1° shown in FIG. 2, as a charge generating material, and one part by weight of poly(vinyl butyral) (Essrec BL-1: made by Sekisui Chemical Co., Ltd.), and 97 parts by weight of methyl ethyl ketone were dispersed by a paint shaker for one hour to prepare a dispersed solution for forming a charge generating layer. The dispersed solution was filled in a tank, the cylindric aluminum support with the interlayer formed thereon was dipped in the tank, the support was pulled up to coat the dispersion and dried at 80° C. for one hour to form a charge generating layer having a thickness of 0.2 μm.

In addition, the measurement conditions of the X-ray diffraction spectrum were as follows.

| | |
|---|---|
| X-ray source | CuKα = 1.5418 Å |
| Voltage | 30 to 40 kV |
| Electric current | 50 mA |
| Start angle | 5.0° |
| Stop angle | 30.0° |
| Step angle | 0.01 to 0.02° |
| Measurement time | 2.0 to 0.5°/minute |
| Measurement method | θ/2θ scanning method |

Hereinafter, the measurement conditions of an X-ray spectrum are same as above.

On the other hand, one part by weight of enamine-base compound shown by the following formula (III) as a charge transport material, (III)

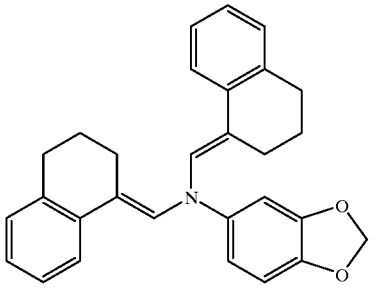

and one part by weight of polycarbonate (PCZ-400: made by Mitsubishi Gas Chemical Co. Inc.) as a binder were dissolved in 8 parts by weight of dichloromethane, the solution obtained was dip-coated on the charge generating layer and dried at 80° C. for one hour to form a charge transport layer having a thickness of 16 μm. Thus, a photoreceptor shown in FIG. 1 was obtained.

For evaluating the photoreceptor prepared in the embodiment according to the invention, using a modification of a commercially available digital copying machine (AR 5130: manufactured by Sharp Co., Ltd.), recording was carried out at a recording density of 1500 dpi and the image was formed using a polymer toner having an average particle size of 5.5±1.4 μm (containing less than 6% toner having a particle size of 7 μm or more, or 4 μm or less) was evaluated. As the result thereof, a clear image having neither fog of white background portions nor minute black spots, wherein a resolution of up to 16 lines/mm was possible, was obtained.

Also, for measuring the absolute sensitivity of the photoreceptor, electrophotographic characteristics were evaluated using an electrostatic recording paper test apparatus (EPA-8200: manufactured by Kawaguchi Electric Works Co., Ltd.). As the result thereof, that a half-value exposure energy required for decaying a surface potential from −500 V to −250 V was 0.05 $\mu J/cm^2$ (wavelength 780 nm, light exposure intensity 2.0 $\mu W/cm^2$) indicating very high sensitivity was shown.

Comparative Example 1

A photoreceptor was prepared in the same manner as in Example 1 except that a charge transport layer having a film thickness of 25 μm was formed. A half-value exposure energy of 0.04 $\mu J/cm^2$ was obtained, which means high sensitivity. Evaluation of image was carried out using polymer toner having an average particle size of 6.5±2.5 μm (containing over 15% toner having a particle size of 9 μm or more, or 4 μm or less). As a result, discrimination of 12 lines/mm or less was possible, and that of 16 lines/mm impossible.

EXAMPLE 2

Figure 3:
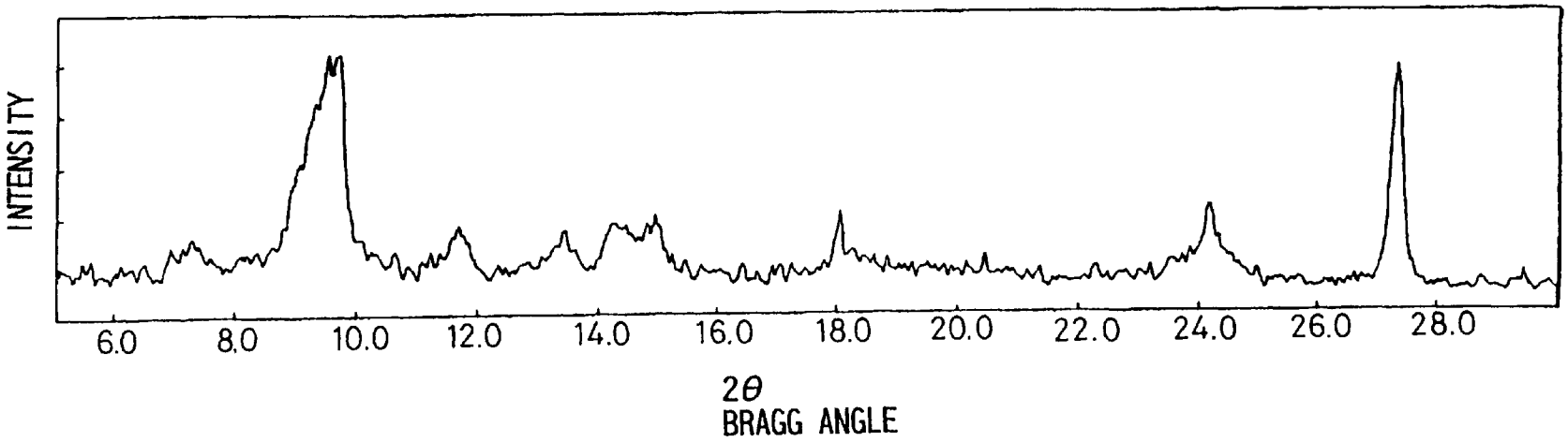
FIG. 3 is a view showing the X-ray diffraction pattern of another crystal-type titanyl phthalocyanine used in the invention.

A photoreceptor was prepared and evaluated in the same manner as in Example 1 except that a crystal-type oxotitanyl phthalocyanine which shows main strong diffraction lines at Bragg angles (2θ±0.2°) of 9.3°, 9.5°, 9.7° and 27.2° in an X-ray spectrum of CuKα characteristic X-ray (wavelength: 1.5418 Å) shown in FIG. 3 was used as a charge generating material.

Evaluation of image was carried out using polymer toner having an average particle size of 5.1±1.1 μm (containing less than 8% toner having a particle size of 6.5 μm or more, or 4 μm or less). A resolution of up to 16 lines/mm was possible and a half-value exposure energy of 0.06 $\mu J/cm^2$ was obtained, which means extremely high sensitivity.

EXAMPLE 3

A photoreceptor was evaluated in the same manner as in Example 1 except that a charge transport layer having a film thickness of 14 μm was formed using a resin as a binder resin for a charge transport layer, which resin was made by mixing polycarbonate resin (PCZ-800; made by Mitsubishi Gas Chemical Co., Ltd.) and polyester resin (Vylon V-290: made by Toyobo Co., Ltd.) in a ratio of 8:2. Evaluation of image was carried out using polymer toner having an average particle size of 5.0±0.8 μm (containing less than 5% toner having a particle size of 6 μm or more, or 4 μm or less). A resolution of up to 20 lines/mm was possible and a half-value exposure energy of 0.05 $\mu J/cm^2$ was shown, which means extremely high sensitivity.

EXAMPLE 4

A photoreceptor was prepared and evaluation of image was carried out in the same manner as in Example 1 except that a coating composition for coating a charge transport layer was prepared by dissolving 1 part by weight of a butadiene compound shown by the following formula (IV):

(IV)

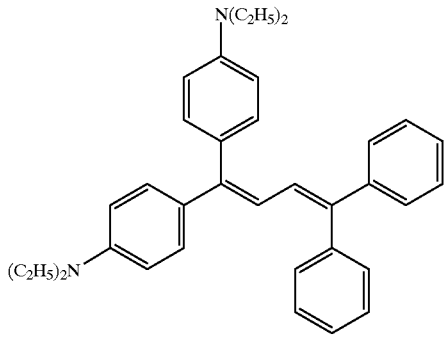

as a charge transport material and 1 part by weight of polycarbonate (PCZ-400: made by Mitsubishi Gas Chemical Co., Ltd.) as a binder in 8 parts by weight of dichloromethane to form a charge transport layer having a film thickness of 15 μm.

To evaluate the receptor prepared in the embodiment according to the present invention, evaluation of image was carried out using polymer toner having an average particle size of 5.5±1.4 μm (containing less than 6% toner having a particle size of 7 μm or more, or 4 μm or less). A resolution of up to 16 lines/mm was possible and a half-value exposure energy of 0.13 $\mu J/cm^2$ was obtained, which means high extremely high sensitivity.

EXAMPLE 5

A photoreceptor was prepared and evaluated in the same manner as in Example 1 except that a coating composition for coating a charge transport layer was prepared by dissolving 1 part by weight of a triphenylamine dimer type compound shown by the following formula (V):

(V)

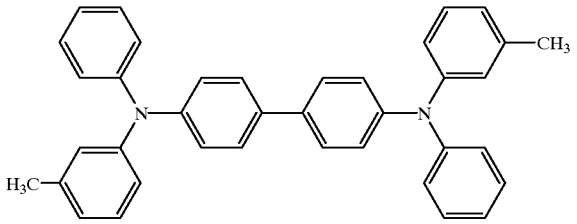

as a charge transport material and 1 part by weight of polycarbonate (PCZ-400: made by Mitsubishi Gas Chemical Co., Ltd.) as a binder in 8 parts by weight of dichloromethane to form a charge transport layer having a film thickness of 18 μm.

To evaluate the receptor prepared in the embodiment according to the present invention, evaluation of image was carried out using polymer toner having an average particle size of 5.5±1.4 μm (containing less than 6% toner having a particle size of 4 μm or less, or 7 μm or more). A resolution of up to 16 lines/mm was possible and a half-value exposure energy of 0.15 μJ/cm$^2$ was obtained, which means high extremely high sensitivity.

EXAMPLE 6

A photoreceptor was prepared and evaluated in the same manner as in Example 1 except that an interlayer made of 90 parts by weight of surface-untreated granular titanium oxide (TTO-55N: made by Ishihara Sangyo Kaisha Ltd.), in stead of surface-untreated needle-like titanium oxide (STR-60N: made by Sakai Chemical Ind. Co., Ltd.) used in Example 1, and 90 parts by weight of copolymer nylon (Amilan CM8000: made by Toray Industries Inc.) was used, and a crystal-type titanyl phthalocyanine which shows diffraction lines of the same strong intensity at Bragg angles (2θ±0.2°) of at least 9.3°, 9.5°, 9.7°, and 27.2° in an X-ray diffraction spectrum of CuKα characteristic X-ray (wavelength: 1.5418 Å) was used as a charge generating material.

As a result of carrying out evaluation of image using polymer toner having an average particle size of 5.1±1.1 μm (containing less than 8% toner having a particle size of 4 μm or less, or 6.5 or more), it was found that a resolution of up to 16 lines/mm is possible. A half-value exposure energy of 0.06 μJ/cm$^2$ was obtained, which means extremely high sensitivity.

EXAMPLE 7

A photoreceptor was prepared and evaluated in the same manner as in Example 6 except that needle-like titanium oxide (STR-60: made by Sakai Chemical Ind. Co., Ltd.) of which surface was treated with $Al_2O_3$ was used in stead of surface-untreated needle-like titanium oxide (STR-60N: made by Sakai Chemical Ind. Co., Ltd.). As a result of carrying out evaluation of image using polymer toner having an average particle size of 5.1±1.1 μm (containing less than 8% toner having a particle size of 6.5 μm or more, or 4 μm or less), it was found that a resolution of up to 16 lines/mm is possible. A half-value exposure energy of 0.06 μJ/cm$^2$ was obtained, which means extremely high sensitivity.

EXAMPLE 8

An electrophotographic photoreceptor characterized in that α-tocopherol as an antioxidant was added to a charge transport layer used in Example 3, in a ratio of α-tocopherol to charge transport material of 2/100 was prepared. The other making conditions are the same as Example 3. As a result of carrying out evaluation of image using polymer toner having an average particle size of 5.0±0.8 μm (containing less than 5% toner having a particle size of 6 μm or more, or 4 μm or less), it was found that a resolution of up to 20 lines/mm is possible. A half-value exposure energy of 0.05 μJ/cm$^2$ was obtained, which means extremely high sensitivity. As for the photoreceptor, as a result of copying about forty thousand times using a duplicator AR5130 (made by Sharp Co., Ltd.), reduction in photoreceptor layer thickness was 2.9 μm, and degradation in charging ability presented no practical problem.

EXAMPLE 9

An electrophotographic photoreceptor characterized in that t-butylhydroquinone as an antioxidant was added to a charge transport layer used in Example 3, in a ratio of t-butylhydroquinone to transport material of 1/100 was prepared. The other making conditions are the same as Example 3. As a result of carrying out evaluation of image using polymer toner having an average particle size of 5.0±0.8 μm (containing less than 5% toner having a particle size of 6 μm or more, or 4 μm or less), it was found that a resolution of up to 20 lines/mm is possible. A half-value exposure energy of 0.05 μJ/cm$^2$ was obtained, which means extremely high sensitivity. As for the photoreceptor, as a result of copying about forty thousand times using a duplicator AR5130 (made by Sharp Co., Ltd.), reduction in photoreceptor layer thickness was 2.6 μm, and degradation in charging ability presented no practical problem.

EXAMPLE 10

An electrophotographic photoreceptor characterized in that t-butylhydroxytoluene as an antioxidant was added to a charge transport layer used in Example 3 in a ratio of t-butylhydroxytoluene to transport material of 5/1000 was prepared. The other making conditions are the same as Example 3. As a result of carrying out evaluation of image using polymer toner having an average particle size of 5.0±0.8 μm (containing less than 5% toner having a particle size of 6 μm or more, or 4 μm or less), it was found that a resolution of up to 20 lines/mm is possible, clearly. A half-value exposure energy of 0.05 μJ/cm$^2$ was obtained, which means extremely high sensitivity. As for the photoreceptor, as a result of copying about forty thousand times using a duplicator AR5130 (made by Sharp Co., Ltd.), reduction in photoreceptor layer thickness was 2.3 μm, and degradation in charging ability presented no practical problem.

EXAMPLE 11

A photoreceptor sample was prepared in the same manner as in Example 1 without providing an interlayer. A half-value exposure energy of 0.04 μJ/cm$^2$ was obtained, which means extremely high sensitivity. The photoreceptor was slightly poor in potential-holding property. Although a resolution of up to 16 lines/mm was possible, an image defect was slightly easily emitted.

EXAMPLE 12

A photoreceptor was prepared and evaluated in the same manner as in Example 1 except that a charge transport layer was formed using polycarbonate resin (C1400: made by Teijin Chemical Ltd.) as a binder resin for the charge transport layer. Although a half-value exposure energy of 0.07 $\mu J/cm^2$ was obtained, which means extremely high sensitivity, as a result of copying about forty thousand times using a duplicator AR5130 (made by Sharp Co., Ltd.), reduction in photoreceptor layer thickness was 4.1 $\mu m$ and degradation in charging ability slightly increased.

EXAMPLE 13

Figure 4:
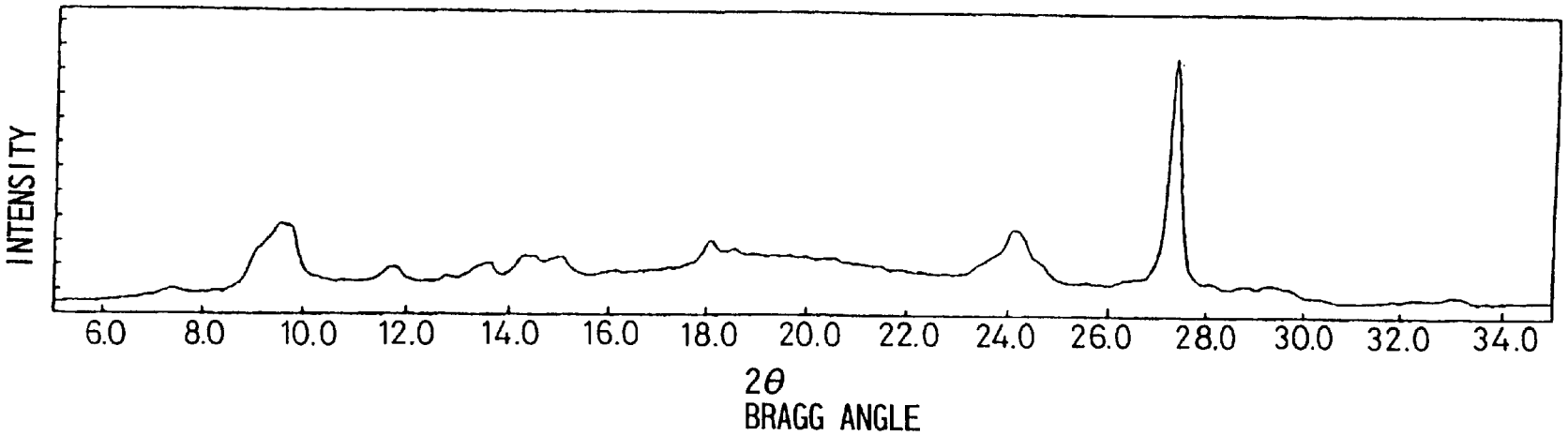
FIG. 4 is a view showing the X-ray diffraction pattern of a crystal-type titanyl phthalocyanine classified as the Y-type.

As for a photoreceptor of Example 13, the photoreceptor was prepared and evaluated in the same manner as in Example 1 except that an interlayer was not formed and a crystal-type oxotitanyl phthalocyanine classified as Y-type which shows a maximum diffraction line at Bragg angle (2θ±0.2°) of 27.3° and also showiing main diffraction lines at Bragg angles (2θ±0.2°) of 7.4°, 9.7°, and 24.2° in an X-ray spectrum of CuKα characteristic X-ray (wavelength: 1.5418 Å) shown in FIG. 4 was used as a charge generating material. Although a half-value exposure energy of 0.24 $\mu J/cm^2$ was obtained, which means extremely high sensitivity, the potential-holding property was extremely poor, so that in the case of charging to −500 V in the dark, a holding rate after five seconds was 81%. Furthermore, regarding an image, fogging on a white background was significant, so that image quality was seriously poor.

EXAMPLE 14

A photoreceptor was prepared in the same manner as in Example 1 except that an interlayer constituted of 120 parts by weight of titanium oxide (STR-60N: made by Sakai Chemical Co., Ltd.) and 60 parts by weight of copolymer nylon (Amilan CM8000: made by Toray Industries Inc.) was provided. Although a half-value exposure energy of 0.09 $\mu J/cm^2$ was obtained, which means extremely high sensitivity, regarding an image, lots of minute black spots were occurred on a white background, so that quality of copy was less-than-high quality.

EXAMPLE 15

A photoreceptor was prepared in the same manner as in Example 1 except that a charge generating layer constituted of 2 parts by weight of a crystal-type titanyl phthalocyanine of Comparative Example 1, which is classified as so-called Y-type, as a charge generating material and 1 part by weight of poly (vinyl butyral) (Essreck BM-1: made by Sekisui Chemical Co., Ltd.) was formed.

Although a half-value exposure energy of 0.21 $\mu J/cm^2$ was obtained, which means high sensitivity, it is found that, in the case of performing halftone recording by pulse width modulation, the potential attenuation of high-duty side was small and tone reproduction was poor. Furthermore, a charged potential in a first rotation after dark adaptation was low, and lots of minute black spots were seen on a white background in an image. And, a large change in level of bright potential under a high temperature and high humidity environment or low temperature and low humidity environment was measured.

EXAMPLE 16

Figure 5:
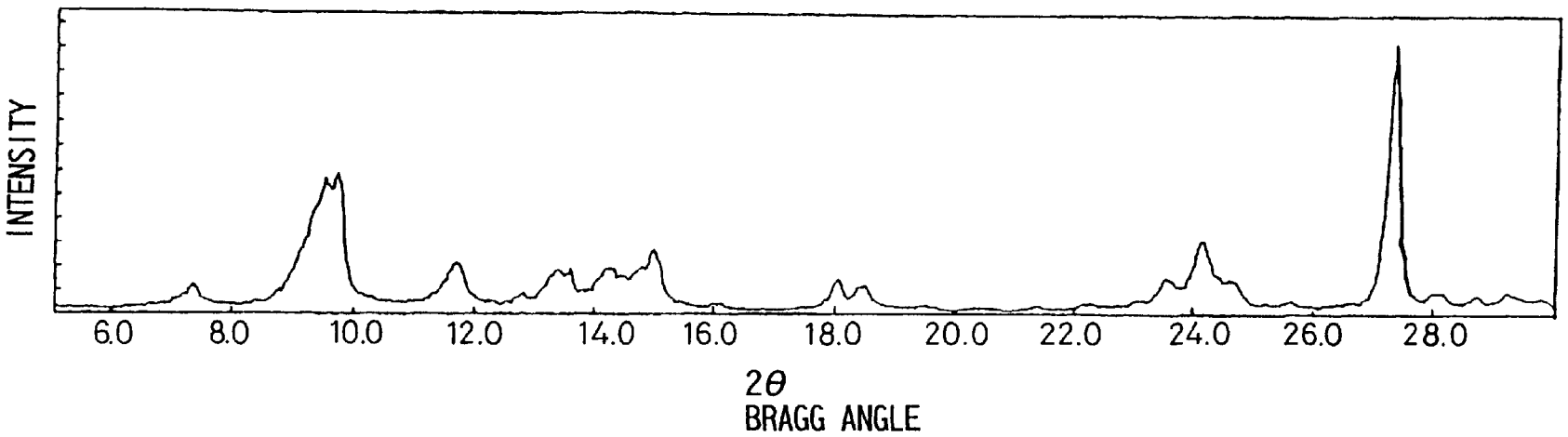
FIG. 5 is a view showing the X-ray diffraction pattern of another crystal-type titanyl phthalocyanine classified as the Y-type.

A photoreceptor was prepared and evaluated in the same manner as in Example 1 except that a crystal-type oxotitanyl phthalocyanine classified as Y-type which shows a maximum diffraction line at Bragg angle (2θ±0.2°) of 27.3° and also shows main diffraction lines at Bragg angles (2θ±0.2°) of 7.3°, 9.5°, 9.7°, 11.7°, 15.0°, 18.0°, and 23.5° in an X-ray spectrum of CuKα characteristic X-ray (wavelength: 1.5418 Å) shown in FIG. 5 was used as a charge generating material. Although a half-value exposure energy of 0.20 $\mu J/cm^2$ was obtained, which means high sensitivity, it is found that, in the case of performing halftone recording by pulse width modulation, potential attenuation of high-duty side was small and the tone reproduction was poor. Furthermore, the charged potential in the first rotation after dark adaptation was low, and lots of minute black spots were seen on a white background in an image. Under the high temperature and high humidity environment, a residual potential of −100 V and degradation by aging were shown.

EXAMPLE 17

Figure 6:
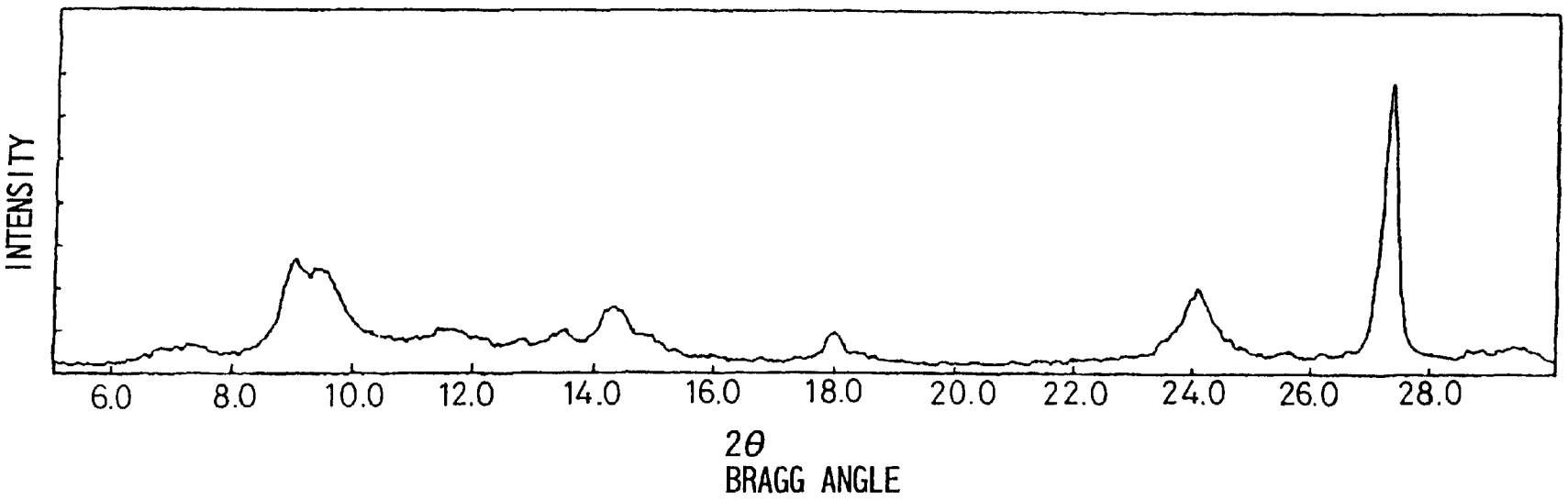
FIG. 6 is a view showing the X-ray diffraction pattern of a crystal-type titanyl phthalocyanine classified to an I-type.

A photoreceptor was prepared and evaluated in the same manner as in Example 1 except that a crystal-type oxotitanyl phthalocyanine classified as I-type which shows a maximum diffraction line at Bragg angle (2θ±0.2°) of 27.3° and also shows main diffraction lines at Bragg angles (2θ±0.2°) of 9.1°, 14.3°, 18.0°, and 24.0° in an X-ray spectrum of CuKα characteristic X-ray (wavelength: 1.5418 Å) shown in FIG. 6 was used as a charge generating material. Although a half-value exposure energy of 0.28 $\mu J/cm^2$ was obtained, which means high sensitivity, a high attenuation of residual potential of −90 V was shown, and it is found that, in the case of performing halftone recording by pulse width modulation, the potential attenuation of high-duty side was small and the tone reproduction was poor. Furthermore, the charged potential in the first rotation after dark adaptation was low, and lots of minute black spots were seen on a white background in an image.

Evaluation methods for the electrophotographic photoreceptors of the respective Examples and Comparative Example described above will be described concretely. Electrophotographic photoreceptors thus produced were evaluated for electrophotographic characteristics by a testing apparatus for electrostatic recording paper (EPA-8200 made by Kawaguchi Electric Works Co., Ltd.). The measurement conditions were an applied voltage of −6 kV and static of No.3, and an exposure amount $E_{1/2}$ ($\mu J/cm^2$) of monochrome light of 780 nm (radiation intensity: 2 $\mu W/cm^2$) isolated with an interface filter required for attenuating from −500 V to −250 V and an initial potential $V_0$ (−V) were measured.

A commercially available digital duplicator (AR5130 made by Sharp Corp.) was modified, and the respective photoreceptor samples were installed therein. Continuous blank copy was carried out 30,000 times (non-copy aging), and $V_0$, $E_{1/2}$, charging ability (a holding rate % of five seconds after charging, before/after), and a change ($\Delta V_L$:V) in light potential level under 5° C./20 % RH of low temperature and low humidity environment or 35° C./85% RH of high temperature and high humidity environment were measured using the testing apparatus for electrostatic recording paper before and after the continuous blank copy. Furthermore, a degradation amount of charging (V) in a first rotation of drum after dark adaptation under a low temperature and low humidity environment, and an image characteristic of a copy obtained by reversal development at a charged potential of −800 V under high temperature and high humidity environment were also measured at the same time.

The results of the respective Examples measured by such evaluation methods are shown in Table 1.

TABLE 1

| | $V_0$ | | $E_0$ | | | | | | |
|---|---|---|---|---|---|---|---|---|---|
| | Initial | After test | Initial | After test | $FV_0 \downarrow$ Initial | $\Delta V_L$ | Image defect | Resolution | Abrasion resistance |
| Example 1 | −501 | −488 | 0.05 | 0.06 | −28 | 41 | OK | (16) | |
| Comparative Example 1 | −518 | −500 | 0.04 | 0.06 | −41 | 36 | OK | (12) | |
| Example 2 | −504 | −485 | 0.06 | 0.08 | −33 | 45 | OK | 16 | |
| Example 3 | −499 | −480 | 0.05 | 0.07 | −18 | 38 | OK | 20 | |
| Example 4 | −500 | −482 | 0.13 | 0.15 | −42 | 51 | OK | 16 | |
| Example 5 | −505 | −489 | 0.15 | 0.16 | −30 | 49 | OK | 16 | |
| Example 6 | −508 | −495 | 0.06 | 0.07 | −37 | 52 | OK | 16 | |
| Example 7 | −510 | −493 | 0.06 | 0.08 | −41 | 44 | OK | 16 | |
| Example 8 | −511 | −490 | 0.05 | 0.07 | −29 | 49 | OK | 20 | Good |
| Example 9 | −508 | −495 | 0.05 | 0.09 | −47 | 55 | OK | 20 | Good |
| Example 10 | −505 | −494 | 0.05 | 0.07 | −33 | 51 | OK | 20 | Good |
| Example 11 | −483 | −465 | 0.04 | 0.06 | −36 | 47 | OK | 16 | |
| Example 12 | −502 | −468 | 0.07 | 0.10 | −44 | 50 | OK | 16 | Somewhat poor |
| Example 13 | −485 | −444 | 0.24 | 0.27 | −114 | 95 | Fog | — | |
| Example 14 | −499 | −487 | 0.09 | 0.10 | −78 | 66 | Minute black spots | 16 | |
| Example 15 | −498 | −480 | 0.21 | 0.23 | −99 | 101 | Minute black spots | 16 | |
| Example 16 | −508 | −499 | 0.20 | 0.27 | −101 | 80 | Minute black spots | 16 | |
| Example 17 | −505 | −500 | 0.28 | 0.33 | −111 | 72 | Minute black spots | 16 | |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor for use in an image forming apparatus for forming a latent image at a resolution of 1200 dpi or more by exposing an object to light and visualizing the latent image with a reversal development system using a toner having an average particle size of 6 $\mu$m or less, the electrophotographic photoreceptor comprising:

an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 $\mu$m or less and containing an enamine structural material shown by the following formula (I) as a charge transporting material:

(I)

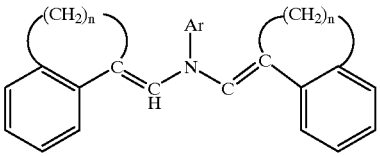

wherein Ar represents an aryl group which may have a substituent, a heterocyclic group which may have a substitutent, an aralkyl group which may have a substitutent, or an alkyl group having a heterocyclic substitutent, and n represents 2, 3 or 4 wherein the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.3°, 9.5°, 9.7°, and 27.2°.

2. An electrophotographic photoreceptor for use in an image forming apparatus for forming a latent image at a resolution of 1200 dpi or more by exposing an object to light and visualizing the latent image with a reversal development system using a toner having an average particle size of 6 $\mu$m or less, the electrophotographic photoreceptor comprising:

an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 $\mu$m or less and containing an antioxidant and a charge transporting material, wherein the antioxidant is selected from the group consisting of α-tocopherol, t-butylhydroquinone, and t-butylhydroxytoluene, and a weight ratio of the antioxidant to the charge transport layer is selected in a range of from 5/1000 to 50/1000;

wherein the charge transport layer further contains a binder resin, which binder resin is a polycarbonate shown by the following formula (II) having a viscosity-average weight of from 35000 to 85000;

(II)

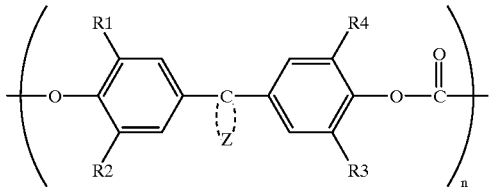

wherein $R_1$ to $R_4$ each represent a hydrogen atom, a halogen atom, or an alkyl group having from 1 to 4 carbon atoms; Z represents an atomic group necessary for forming an unsubstituted carbon ring or a substituted or unsubstituted heterocycle, and wherein the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.3°, 9.5°, 9.7°, and 27.2°.

3. The electrophotographic photoreceptor of claim 2, wherein the charge transport layer contains an enamine structural material shown by the following formula (I) as the charge transporting material:

(I)

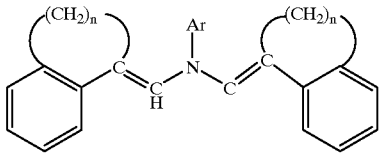

wherein Ar represents an aryl group which may have a substituent, a heterocyclic group which may have a substitutent, an aralkyl group which may have a substitutent, or an alkyl group having a heterocyclic substitutent, and n represents 2, 3, or 4.

4. An electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising:

an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing an enamine structural material shown by the following formula (I) as a charge transporting material:

(I)

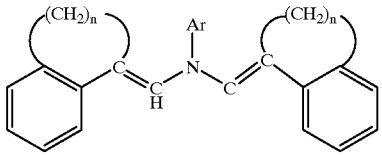

wherein Ar represents an aryl group which may have a substituent, a heterocyclic group which may have a substitutent, an aralkyl group which may have a substitutent, or an alkyl group having a heterocyclic substitutent, and n represents 2, 3 or 4, and wherein the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4°, 9.6°, and 27.2° and shows diffraction lines at Bragg angles (2θ±0.2°) of 7.3°, 11.6°, and 24.1°.

5. An electrophotographic photoreceptor for use in an image forming apparatus for forming a latent image at a resolution of 1200 dpi or more by exposing an object to light and visualizing the latent image with a reversal development system using a toner having an average particle size of 6 μm or less, the electrophotographic photoreceptor comprising:

an electrically conductive support; and a photosensitive layer composed of a charge generating layer formed on the electrically conductive support, containing an oxotitanyl phthalocyanine as a charge generating material, and a charge transport layer formed on the charge generating layer, having a thickness of 20 μm or less and containing an antioxidant and a charge transporting material, wherein the antioxidant is selected from the group consisting of α-tocopherol, t-butylhydroquinone, and t-butylhydroxytoluene, and a weight ratio of the antioxidant to the charge transport layer is selected in a range of from 5/1000 to 50/1000;

wherein the charge transport layer further contains a binder resin, which binder resin is a polycarbonate shown by the following formula (II) having a viscosity-average weight of from 35000 to 85000;

(II)

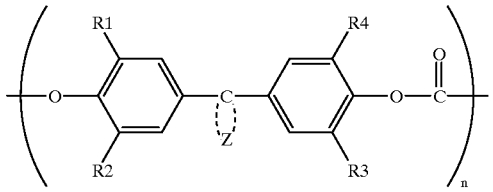

wherein $R_1$ to $R_4$ each represent a hydrogen atom, a halogen atom, or an alkyl group having from 1 to 4 carbon atoms; Z represents an atomic group necessary for forming an unsubstituted carbon ring or a substituted or unsubstituted heterocycle, wherein the oxotitanyl phthalocyanine shows, in an X-ray diffraction spectrum of CuKα characteristic X-ray (wavelength: 1.5418 Å), main strong diffraction lines at Bragg angles (2θ±0.2°) of 9.4°, 9.6°, and 27.2° and shows diffraction lines at Bragg angles (2θ±0.2°) of 7.3°, 11.6°, and 24.1°.

6. The electrophotographic photoreceptor of any one of claims 1, 2, 4 or 5, the electrophotographic photoreceptor further comprising an interlayer between the photosensitive layer and the electrically conductive support.

* * * * *